United States Patent [19]

Martin et al.

[11] 4,387,583

[45] Jun. 14, 1983

[54] BENDING AND FORMING TOOL

[75] Inventors: Earl C. Martin, Dayton; John K. Thompson, West Carrollton; Robert J. Gargrave, Dayton, all of Ohio

[73] Assignee: Ready Systems, Inc., Dayton, Ohio

[21] Appl. No.: 179,264

[22] Filed: Aug. 18, 1980

[51] Int. Cl.[3] ..... B21D 5/01

[52] U.S. Cl. ..... 72/22; 72/25; 72/332; 72/334; 72/382

[58] Field of Search ..... 72/332–334, 72/384, 386, 387, 294, 306, 25, 22, 382

[56] References Cited

U.S. PATENT DOCUMENTS

| | | | |
|---|---|---|---|
| 1,229,572 | 6/1917 | Birnzweig | 72/333 |
| 1,711,795 | 5/1929 | Kinney | 72/333 |
| 1,766,217 | 6/1930 | Booth | 72/334 |
| 3,154,972 | 11/1964 | Neumeier et al. | 72/294 |
| 4,112,732 | 9/1978 | Okunishi et al. | 72/334 |

FOREIGN PATENT DOCUMENTS

| | | | |
|---|---|---|---|
| 431931 | 6/1974 | U.S.S.R. | 72/384 |

*Primary Examiner*—Daniel C. Crane
*Attorney, Agent, or Firm*—Jerome P. Bloom

[57] ABSTRACT

Bending and forming apparatus comprises an anvil adapted for use in a press in conjunction with a die connected to an opposed portion of the press, to form and bend material interposed therebetween as the press closes during its cyclic operation. The anvil includes a plurality of elements each of which is normally fixed to form an extension of another by an embodied locking device. In its extended condition the anvil is a rigid unitized structure of substantially fixed length. The locking device is constructed and arranged to release to provide the elements as hard tooling of reduced length as bending and forming of the material worked thereby proceeds, to set the bent and formed configuration of the material worked. A trigger device is included for triggering the release of the locking device to provide for reduction in length of the anvil. The bending and forming apparatus provides hard tooling in both its original condition and when reduced in length.

24 Claims, 16 Drawing Figures

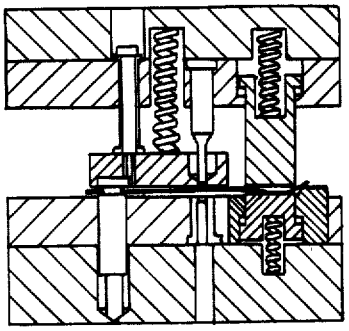
FIG-1
FIG-2
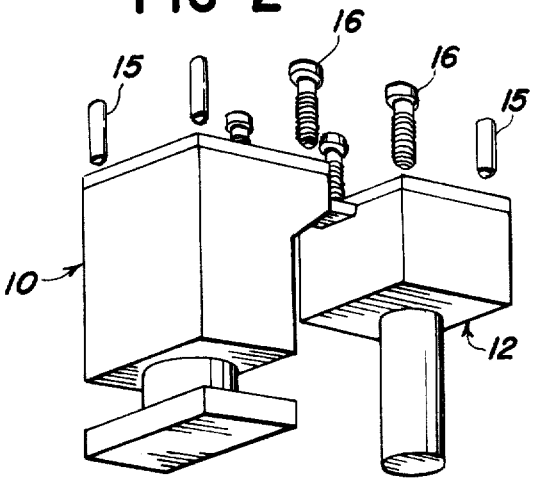
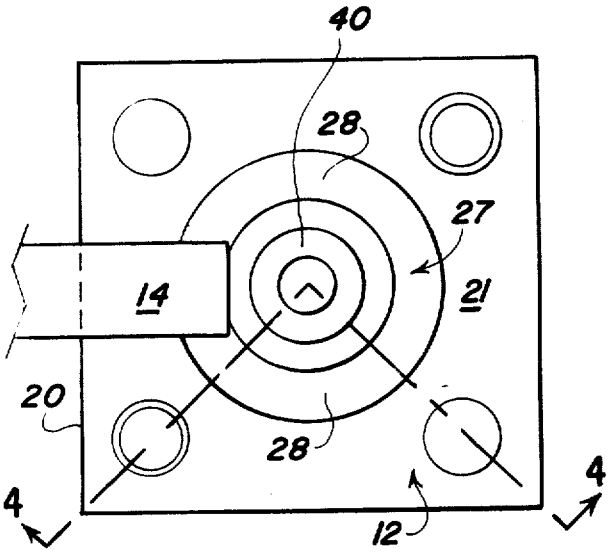
FIG-3
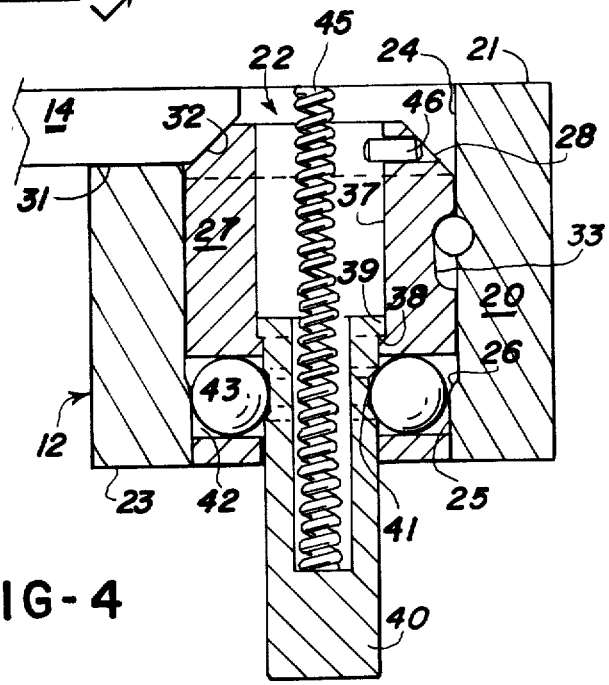
FIG-4

BENDING AND FORMING TOOL

BACKGROUND OF THE INVENTION

This invention relates to new and improved bending and forming apparatus embodiments of which are particularly advantageous for use in up bending or "air" bending procedures and as part of a die assembly incorporated in a press.

The invention will be described in this frame of reference, but only for purposes of illustration and not by way of limitation, either as to its application or the form of its embodiment.

In the use of known tools and systems for bending and forming, it has invariably been found that the material worked has been distorted and undesirably stressed. This affects adversely the quality of the end product. This problem which the present invention solves becomes more readily apparent when considering a representative installation of the prior art in which up bending takes place. See FIG. 1 of the accompanying drawings in this respect. As seen therein, the conventional bending and forming tool is a spring biased anvil device mounted in connection with an upper die plate forming part of the upper half of a die assembly. Its lower half incorporates a spring biased pad in an aligned opposed relation to the anvil. This pad is in a side by side relation with a forming die which together therewith interrelates with the anvil in a bend and form operation as the die assembly is closed in a cyclic operation of the press in which it is embodied. By reason of the bias thereon, the pad provides a surface normally elevated relative to the upper or matrix surface of the lower die plate, reaching to the upper level of the projected operating portion of the forming die. The pad provides a backing over which material to be worked moves to the projected co-planar part of the forming die in establishing its working station. As shown, schematically, the lower die plate will incorporate an additional die or dies, respectively located for a cooperative working relation with a punch or cutting tool or a plurality thereof in connection with and fixed to depend from the upper die plate. As conventionally illustrated, the upper die plate suspends a spring biased stripper plate through which the cutting and/or punching tool or tools must pass on the closing of the die assembly to interact with its or their aligned die in cutting or punching the material being worked. During the closing of the die assembly the stripper plate is biased to be in advance of the working end or ends of the cutting and punching tool or tools and serves to hold the material to be worked so such tools can properly function. For convenience of illustration, in FIG. 1 only a single spring is shown with each of the stripper plate and the pad opposed to the forming anvil. In fact, however, a plurality of springs is applied in each instance, producing a complexity in their choosing and arrangement in efforts to balance the associated apparatus in the course of its function. The installation of such apparatus in a proper relationship has always been very difficult and time consuming.

In the cyclic operation of the press in which the die assembly of FIG. 1 is incorporated, the upper half of the die assembly will move towards a closed position with reference to the lower half in the process of which the spring biased anvil is the first tool to engage the material to be worked. It is desirable that in its first contact the anvil sets the material against the spring biased pad and the co-planar projected portion of the forming die, to condition it and fix its position for the bend and form operation. In the wipe bending procedure schematically illustrated in FIG. 1, it will be seen that as the anvil moves downwardly to initiate the bend, it applies pressure to the material worked in an adjacent but spaced relation to that portion of the forming die which serves as its base. The consequence, seen in FIG. 1, is an inherent and naturally resulting distortion of the material being worked, resisted only in part by the spring biased pad adjacent the forming die. What in fact happens is that irregularities occur in the plane of the material and stress is built therein as the initial bending and forming proceeds. Keep in mind that during this initial bending and forming operation the bias of the anvil in respect to the material worked is opposed by the spring bias on the pad. The interaction is not by any means firm and positive as to control of the material. The stress and distortion embodied in the material worked during the initial bend and form operation (known as "air bending") is built into the end product as the die assembly is brought to a fully closed condition. At such time the cutting and punching tools function and whatever bend and form has been effected is set. The problems of stress and distortion of the material are compounded in the closing procedure by the interaction of the stripper plate, as biased by its backing springs. There are just so many spring forces involved and imposed on the material as the die assembly is closed that full or reasonably full control of the positioning of that portion of the material which is being bent and formed and then set is extremely difficult. There is no positive assurance that the material can be held to maintain that position which is most desirable for achieving the best possible results.

The problems present in the closing of the prior art die assembly such as shown in FIG. 1 are not the sole problems. With spring bias on both the anvil type bending and forming tool and the opposed spring pad, there can be reactant forces acting on the material immediately following the working thereof and the opening of the die assembly.

It is thus clear that the use of a maze of springs to control stock, the working of which includes bending and forming operations, precludes an optimal balance of the forces applied to the material in the working thereof. Not only this, but to get an installation of the springs utilized in a form reasonably suited for the application, there has to be a lot of "cut and try" before an acceptable result occurs.

The foregoing summarizes the state of the prior art and its deficiencies, which create obvious problems the solution of which is urgently required.

The inventors are not aware of any prior art pertinent to the specific improvements of the present invention.

SUMMARY OF THE INVENTION

To overcome the problems of the prior art, the invention provides a bending and forming tool which is not per se spring biased. It is constructed to have two stages in its operation, in the first of which it is rigid and fixed as to its length and in the second of which its length is reduced, as required to enable the die assembly in which it is embodied to fully close. Its length is reduced in a triggering action effected as bending and forming takes place and immediately prior to achieving a closed condition of the die assembly. In its reduced length, as well as in its original length, the invention apparatus provides hard tooling which enables a most firm set of the bend achieved and the fixing of the shaped material in the form to which it has been worked. The requirement for control of the tool by opposed springs is eliminated, thereby greatly reducing the complexity of providing an installation of a die assembly in which bending and forming must take place. At the same time the prior incidence of undesirable stress and distortion of the material worked is essentially eliminated.

In preferred embodiments of the invention, the bending and forming tool includes an anvil part and a triggering sensor part. The anvil part is preferably comprised of telescopically related components and includes locking means arranged to normally maintain a predetermined fixed length of the tool for an initial bend and form operation. This locking means is designed to release upon energization of the triggering sensor part, whereupon the basic components of the anvil relatively telescope on themselves to effect the reduced length thereof required to enable the die assembly with which they are incorporated to fully close. The energization of the sensor occurs as the initial bend and form operation is being effected by the anvil part. In the examples illustrated, the sensor element is arranged to be energized by its engagement to the stripper plate, the matrix surface of the lower die plate, or the lower shoe of the tool and die assembly in which the bending and forming tool is embodied.

It is accordingly a primary object of the present invention to provide a bending and forming tool which is easy to fabricate, more efficient and satisfactory in use, adaptable to a variety of applications and forms of its embodiment and unlikely to malfunction or unduly stress material worked.

A further object is to provide hard tooling for a bending and forming operation constructed and arranged to provide an anvil which has one fixed length maintained for the initial bending and forming operation which is automatically reduced to achieve the required set.

Another object is to provide a bending and forming tool the use of which eliminates the need for primary spring control thereof in its application.

An additional object of the invention is to provide a bending and forming tool the use of which minimizes the chance or incidence of distortion or stress of the material on which it works.

A further object of the invention is to provide a bending and forming tool comprised of telescoped parts having a first fixed length achieved by embodied locking means and a triggering device energized as initial bending and forming is being completed to release said locking means and produce a reduction in length of the tool for a setting operation as the tool and die assembly in which this apparatus is embodied is closed.

Another object is to provide a bending and forming tool and a method of its application in a tool and die assembly possessing the advantageous features, the inherent meritorious characteristics and the means and method of its application herein set forth.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the drawings wherein one but not necessarily the only form of embodiment of the present invention is illustrated, FIG. 1 schematically illustrates a bending and forming operation using the tooling of the prior art, illustrating conditions which lead to undue and undesirable distortion and stress of the material worked;

FIG. 2 is a perspective view of a bending and forming tool showing one embodiment of the present invention;

FIG. 3 is a top plan view of the sensor part of the tool of FIG. 2;

FIG. 4 is a sectional view taken on line 4—4 of FIG. 3 illustrating the sensor parts in their normal inoperative position;

Like parts are indicated by similar characters of reference throughout the several views.

Figure 5:
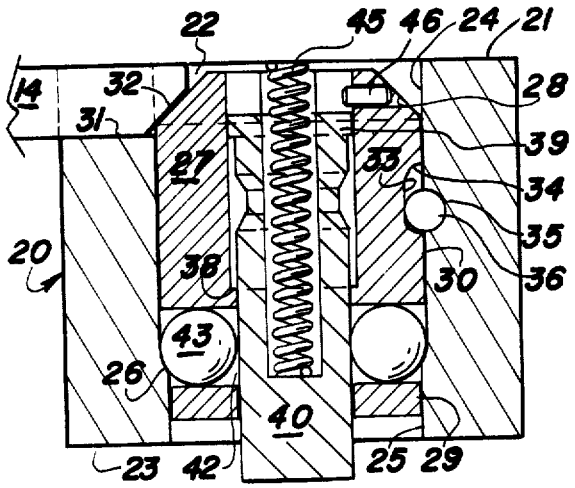
FIG. 5 is a view similar to that of FIG. 4 but with the sensor parts shown in their triggering position.
Figure 6:
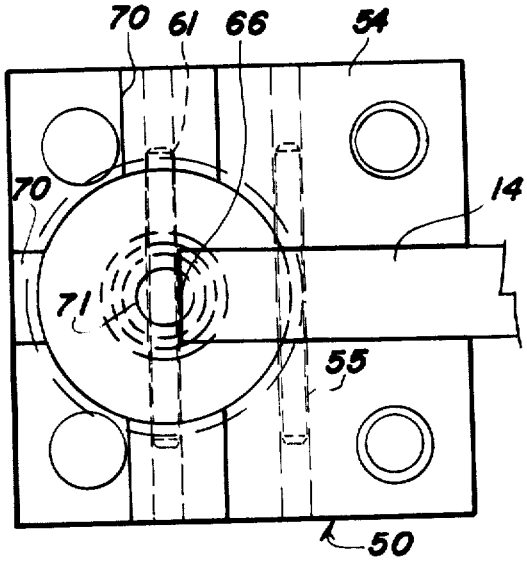
FIG. 6 is a top plan view of the anvil part of the apparatus of FIG. 2.

DESCRIPTION OF THE EMBODIMENT OF THE INVENTION ILLUSTRATED:

The preferred embodiment of the invention illustrated in FIGS. 2–14 of the accompanying drawings comprises an anvil unit 10 and a sensor unit 12 operatively connected by a trigger bar 14. As shown, the anvil unit 10 and sensor unit 12 are each located and fixed by two dowels 15 and two screws 16 to depend from and perpendicular to the upper die plate 17 of a die assembly as fixed in a press. The anvil and the sensor are spaced to accommodate the length of the bar 14 and its function.

The die assembly also includes an upper shoe 18 and a lower shoe 19, the nature and character of which are well understood by those versed in the tool and die arts. The upper and lower die plates, 17 and 13 respectively, of the die assembly illustrated are conventionally secured to and backed, respectively, by the die shoes 18 and 19, which will be secured in turn to the ram and bed of the press in which the assembly is mounted.

While the anvil 10 and sensor 12 are shown as backed by the plate 17 and will be so described, it is to be understood that in some instances they may mount directly to the upper die shoe 18, separate from the plate 17 but as part of the die system, to function with the other tooling in a progressive pattern.

The sensor 12 is shown to comprise a rectangular block-shaped housing 20, the upper surface 21 of which is flush abutted to the undersurface of the upper die plate 17. The housing 20 has a central bore 22 opening at one end from the surface 21 and at the other from its remote surface 23 and mounts so that the central longitudinal axis of its bore 22 is perpendicular to the plate 17.

The bore 22 is stepped as to its diameter by a counterbore which extends, from the surface 21 towards the surface 23, about 75 to 80% of its axial length. This counterbore produces an extended section 24 of the length of the bore wall separated from a short section 25 thereof by a very short length of the bore wall providing a conically convergent section 26. At its convergent end which merges with the section 25 the diameter of the section 26 corresponds to the diameter of the section 25. Correspondingly the diameter of section 26 at its expanded end corresponds to the somewhat larger diameter of the section 24 which has been produced by the counterbore. The section 26 of the bore wall thus provides a relatively narrow annular shoulder facing outwardly of the end of the bore which opens from the surface 21.

A sleeve-like tubular element 27 is slip fit to mount in bearing relation to the wall of the bore 22. As disposed in the bore 22, when the housing 20 is fixed to depend from the plate 17, the outer surface of sleeve 27, other than for the conically convergent configuration of an end portion 28 which disposes uppermost, is complementary in configuration to the bore wall. The outer surface of the sleeve 27 thus comprises a section 29 at its lower end corresponding in axial length to that of wall section 25, a very short section forming an annular shoulder complementary in configuration to and seating to the shoulder 26, and a section 30 complementary in configuration and diameter to that of the wall section 24 but shorter in length. The axial length of sleeve 27 is thus less than that of the bore 22 and, in its normal position therein just described, the upwardly convergent sloping surface of its end portion 28 has a section thereof in line with a rectangular notch 31 opening through and from one side of the housing 20 and from its upper surface 21 and to the bore 22. The notch 31 accommodates the projection into the bore 22 of one end of the trigger bar 14 to have the sloped undersurface portion 32 thereof bear on the facing complementary section of the end surface portion 28 of the sleeve 27.

A short axially extended recessed flat 33 is formed in the outer surface of the sleeve 27, centered between its end portion 28 and its shoulder portion. The recess defining the flat 33 has a radiused end wall 34 provided at each of its axial limits.

Housing 20 is intersected by a through bore 35 which intersects the bore 22 and the wall thereof intermediate the axial limits of the section 24. The bore 35 accommodates the press fit therein of a pin 36 the radius of which corresponds generally to that of the radiused wall 34 to either end of the flat 33. The location of pin 36 is such that as it in part intersects the bore 22, that part which intersects extends into the recess bounded by the flat 33 and the radiused end walls 34 in the sleeve 27, to normally bear on the end wall 34 which is uppermost. As will be seen, the pin 36 prevents the displacement of the sleeve 27 from the bore 22 and in any case limits the possible axial movement or displacement of the sleeve within the limits of the bore 22.

The bore of the sleeve 27 has a counterbore 37, in the end thereof disposing uppermost as it seats within the bore 22 of the housing 20. The counterbore 37 produces an upwardly facing narrow annular shoulder 38. The shoulder 38 seats the external flange 39 on one end of an elongate cylindrical sensor element 40. A blind bore in the upper end of the element 40 has nested therein and seated to the base thereof one end of an elongate coil spring 45, which as the entire sensor unit is fixed to depend from die plate 17 has its other outwardly projected end contained by and abutted to the plate 17. The spring 45 is thereby placed under compression to maintain the flange 39 in an abutted relation to shoulder 38. The body of the sensor element 40 depends through and from the lower end of the sleeve 27 and from housing 20, to dispose in vertically dependent relation thereto.

The sensor element 40 has an axially extended circumferential groove 41 in its outer surface. As the sleeve 27 seats in the housing 20 and the flange 39 seats to the shoulder 38, the groove 41 is centered within the axial extent of four circumferentially spaced apertures 42 in the sleeve 27. The apertures 42 are in adjacent but spaced relation to the end of the sleeve which disposes lowermost in the bore of the housing 20. The axial extent of the apertures 42 is such that at this point the shoulder 26 in the wall of bore 22 lies in a plane slightly above the horizontal diametral plane of ball bearing elements 43, one of which is in each aperture 42. The spherical elements 43 are dimensioned to project inward of the lower end of the bore of sleeve 27 to be accommodated by the groove 41, the axially limiting wall surfaces of which are divergent in nature.

Thus, with the sensor element 40 in its unenergized position, shown in FIG. 4 of the drawings, the wall section 25 of bore 22 confines the ball bearing elements 43 in a peripheral sense and by reason of their dimension the elements 43 are pushed into the groove 41 to frictionally engage its base and the wall section 25. The so confined arrangement of the ball elements 43 establishes them in a position to resist axial displacement of the sensor element 40 upwardly of the sleeve 27 and the housing 20, against the containing influence of bar 14, until a predetermined pressure is applied thereto.

A radial aperture in the conically convergent end portion 28 of the sleeve 27 has press fit therein a pin 46. The pin 46 projects into the uppermost end of bore 22 to limit upward movement of the sensor element 40, as installed, and its inadvertent release from the sleeve 27, once assembled.

The anvil unit 10 is a primary bending and forming tool including a generally rectangular block-like housing 50. The housing 50 has a through bore 52 opening at one end from its upper surface 54 which is fixed in flush abutted relation to the underside of die plate 17. The central longitudinally extending axis of the bore 52 mounts perpendicular to the plate 17. The lower end of this bore has a counterbore 56 of limited depth, forming in the wall thereof a shoulder 57 which is convergent in cross section, in the direction of the surface 54.

A cup shaped cylinder 51 is inserted in the bore 52 through the counterbored end thereof, which opens from the housing bottom surface 58. The cylinder 51 is uniform as to its outer diameter, the dimension of which provides that its peripheral outer surface mounts in bearing relation to the wall of the bore 52. The peripheral surface of the cylinder 51 has a recessed flat 53 corresponding in nature to the flat 33 on the sleeve 27. The flat 53 has a limited axial extent, its end walls are radiused and the space which it defines with the facing portion of the wall of bore 52 is intersected by a pin 55, press fit in a through aperture in the housing 50. The pin 55 serves as a retention and limit pin which not only prevents disengagement of the cylinder 51 from its housing but suspends this cylinder as it limits against the end wall defining the upper limit of the recess defined by the flat 53.

With the cylinder 51 thus suspended, its upper end is adjacent but spaced from the surface 54. Its lower end 77 depends from and below the housing 50 to nest in a cup-like anvil shoe 59 and be fixed thereto by a pin 61. The lowermost surface 60 of the shoe 59 is planar in character and radiused at its working edge 62. The edge 62 merges smoothly with an upwardly directed, inwardly inclined, forming surface 63 defined by one side of the outer peripheral wall surface of the shoe.

A coil spring 64 within the cylinder 51 has one end thereof abutted to the inner surface of its base while its opposite end nests in an axially extended blind bore 65 formed in the base end of a piston like element 66.

The element 66 has a generally cylindrical outer surface. Axially spaced portions of its length which exhibit its maximum outside diameter provide a bearing relation thereof to the inner peripheral wall surface of the cup. These axially spaced portions include a portion 67 at its base end which is short in axial length and a portion 68 adjacent its remote end having a greater length. The said remote and upwardly disposed end 69 of the element 66 is conically convergent at its outer surface like end portion 28 of the sleeve 27. In its normal position the sloping surface 69 of the piston 66 presents itself opposite the open inner ends of four notches 70 formed in the upper surface 54 of the housing 50 spaced 90° apart. The outer ends of the notches 70 respectively open from a different one of the outer side surfaces of the housing 50. A selected one of the notches 70 accommodates the projection therein of the end 71 of the trigger bar 14 remote from that end associated with surface portion 28 of the sleeve 27. The lower portion of the extremity of the end 71 has a sloped surface 72 complementary in shape to the portion of surface 69 on which it bears.

In mount of the anvil 10 and the sensor unit 12 their spacing will correspond to the length of the trigger bar 14. The provision of four notches 70 gives flexibility as to the relative positioning of these units.

Figure 7:
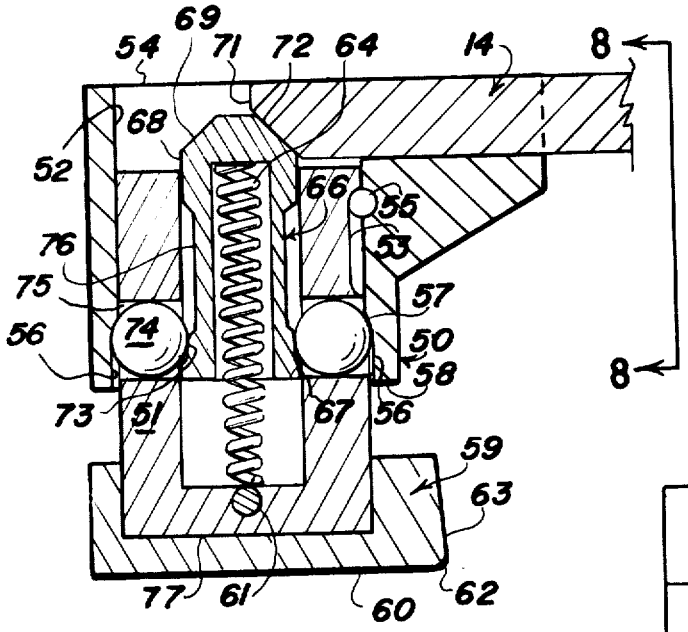
FIG. 7 is an elevation view of the anvil part shown in vertical section.
Figure 8:
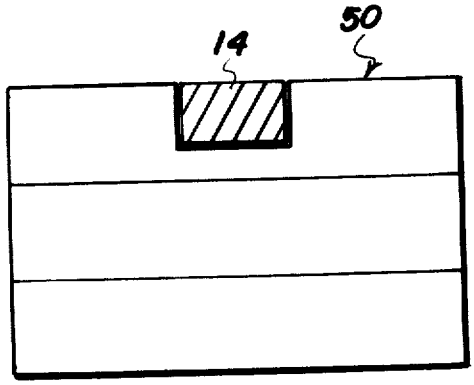
FIG. 8 is a view taken on line 8—8 of FIG. 7.
Figure 9:
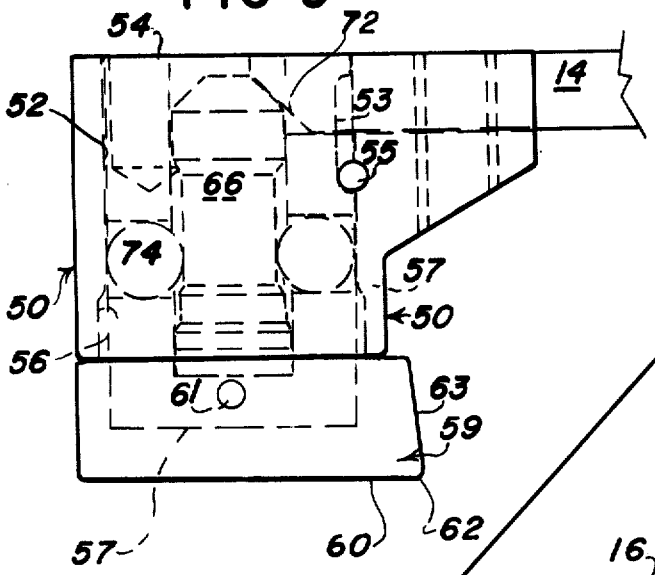
FIG. 9 is a side elevation view of the anvil part in which the operative length thereof has been reduced as a consequence of the operation of the sensor part.
Figure 10:
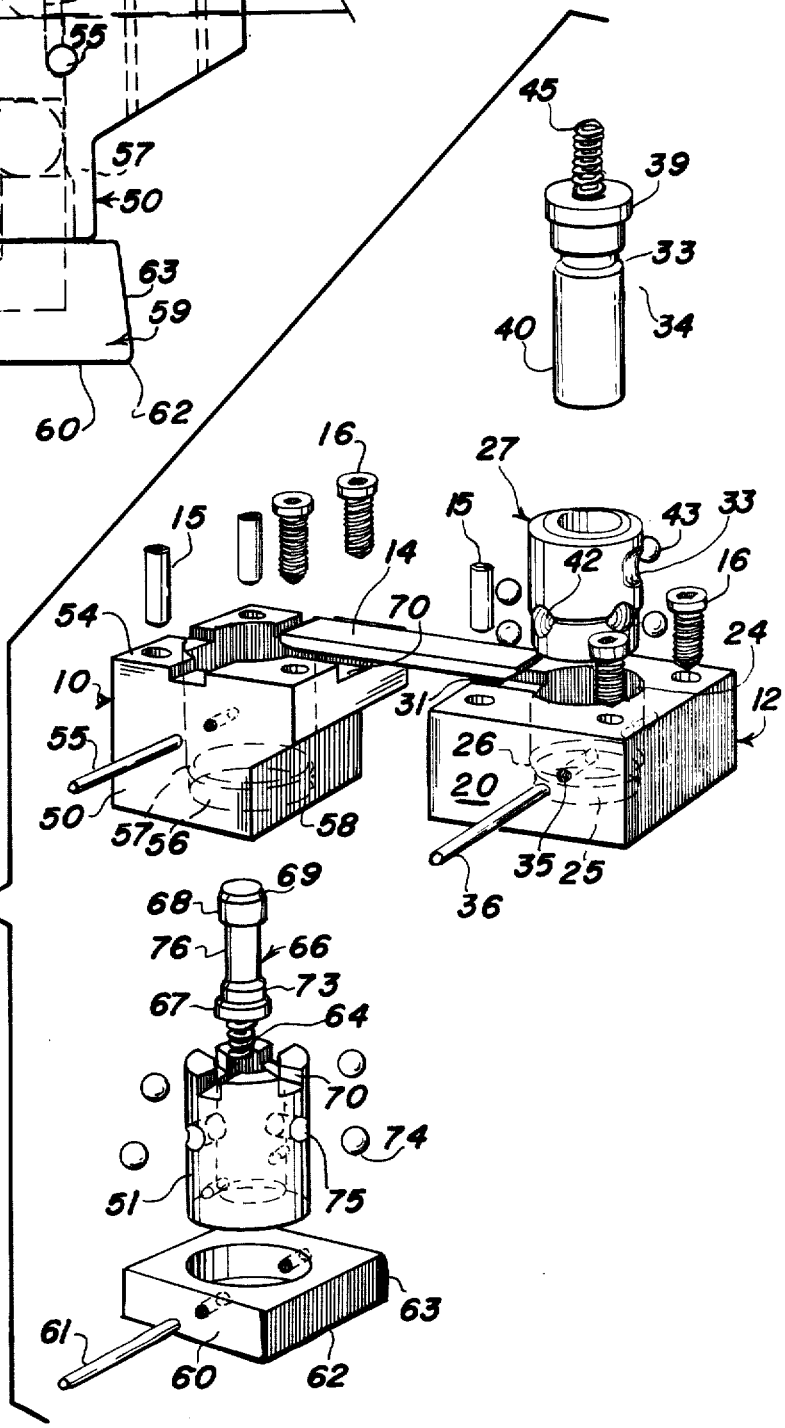
FIG. 10 is an exploded view of the bending and forming tool, including the anvil and its controls, illustrated in FIGS. 2 through 9.

As seen in FIG. 7, the outer surface of element 66 is reduced in diameter for a short portion 73 of its axial extent immediately upward of its base end portion 67. This reduction accommodates the projection inwardly of the peripheral wall of the cup-like element 51 of portions of four circumferentially and equidistantly spaced ball bearing elements 74. Each element 74 is accommodated in one of four equidistantly and circularly spaced apertures 75 in the peripheral wall of the element 51. With the element 51 normally positioned and suspended as shown in FIG. 7, the diameter of the ball bearings 74 is sufficiently large and they are so positioned in a vertical sense as to project to and bear on the wall of counterbore 56 and against the shoulder 57. The simultaneous engagement of the ball elements 74 to the portion 73 of the outer surface of element 66 at the same time is found to produce an effective friction lock between the components fixing the cylinder 51 in its maximum extended relation to the housing 50. The anvil unit thus illustrated in FIG. 7 has a normal fixed length, defined by the degree of extension of the cylinder 51 and its attached shoe from the housing 50.

The section 76 of the outer surface of the element 66 extending from its surface portion 73 to its portion 68, exhibits its minimum outer diameter.

As will be seen, when the sensor element 40 is energized to move the ball elements 43 and sleeve 27 upwardly in the housing 20, elements 43 rise above and are forced by relative upward movement of the sensor element to move outwardly on the shoulder 26 and the trigger bar 14 is cammed outwardly of the sensor unit and inwardly of the anvil unit to cam the piston 66 downwardly of the interior of the cylinder 51. The downward movement of piston 66 moves the piston surface portion 73 clear of the ball elements 74 and presents to these elements its portion 76 which exhibits its minimum diameter. This permits force applied to the bottom of the anvil shoe to be transmitted to the ball elements 74 to force them inwardly of the shoulder 57, thereby to permit the cylinder 51 and the balls 74 to be carried for a short distance upwardly of the bore 52. This upward movement is contributed to by the shoulder achieved on the piston element 66 between its outer surface portions 73 and 76.

It will be understood, of course, that description as to direction and designation of upper or top and lower or bottom are in each case with reference to orientation of the elements as seen in the accompanying drawings.

Referring to FIGS. 11–14, these diagrammatically illustrate the function of the invention apparatus as applied as part of a die system placed in a press and in connection with its upper die plate 17. Briefly, for purpose of demonstration, the associated punching and cutting tools as may be required are represented by a single punch 80 conventionally retained in connection with the plate 17, to depend therefrom and perpendicular thereto. Also shown is a stripper plate 82 suspended by conventional hangers 84 from the plate 17 to normally position in advance of the operating ends of the cutting and punching tools and apertured to pass them when the die assembly is closed.

For convenience of illustration, the anvil and sensor units are shown widely spaced by the elongated trigger bar 14 which functionally relates these parts. The sensor element 40 will in fact be positioned and spaced to one side of the material worked so that it is energized by direct and forceful engagement of its dependent extremity to the matrix surface of the lower die plate as the die assembly is being closed, to timely and properly trigger a reduction of the length of the anvil unit as and when required. As will be seen the arrangement provides a safety factor, insuring the reduction in length of the anvil tool to permit closing of the die assembly without damage even if the material "M" to be worked is not present.

As further shown diagrammatically in FIGS. 11–14 the lower die plate 13 mounts upwardly biased control elements 88 for guiding the material "M" to be worked to its working station, at a level above and spaced from the upper or matrix surface of the plate 13 and over the rotary forming die 90. The plate 13 conventionally mounts such dies 92 as are required to align and work with the respective cutting and punching tools as the die assembly is brought to a completely closed condition.

Since the details of conventional tools and dies are well known by those versed in the art, they need not be further described. Suffice it to state that the forming die 90 is illustrated as to its base, in this case secured to the die shoe 19, which nests for limited rotation in its upper surface in a die rotor 94 having a V-shaped notch 96 the bounding wall surfaces of which cooperate with the shoe of the anvil unit in its bending and forming function.

Figure 11:
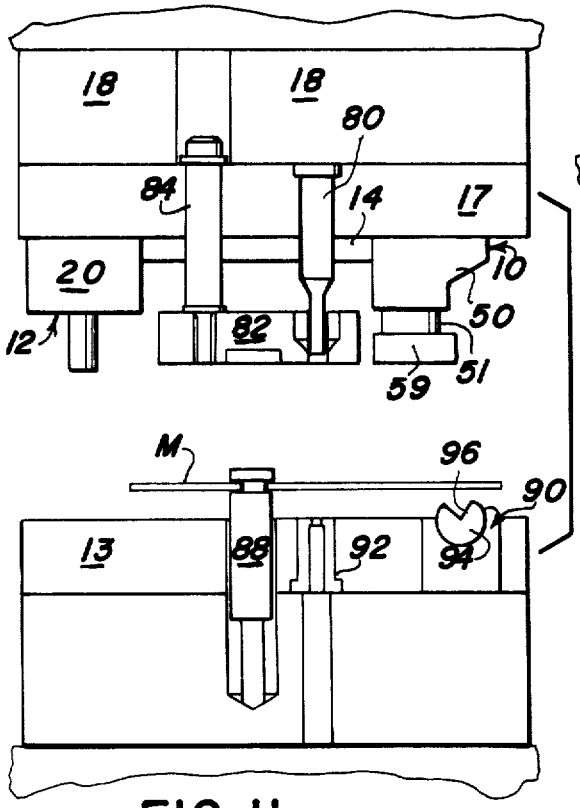
FIGS. 11–14 show a generally schematic representation of a closing cycle of a die assembly embodying the structure of FIGS. 2–10.
Figure 12:
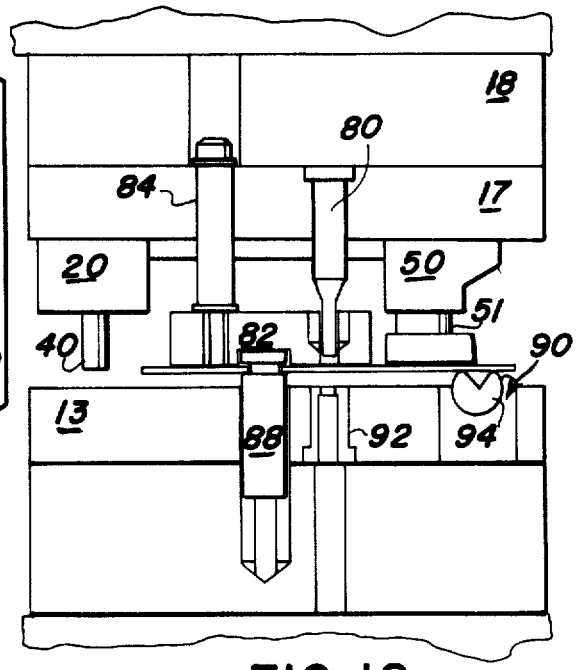

FIG. 11 shows the die system described, including the invention tooling, in an open condition, wherein the material "M" to be worked has been guided over and in spaced elevated relation to the matrix surface of the lower die plate 13 and the rotor 94 of the forming die the notch of which faces vertically upward. As seen, the upper level of the rotor projects above the upper or matrix surface of the plate 13 as well as its base.

As the press commences its cyclic action, the stripper plate 82 and the shoe 59 of the anvil unit 10 are all co-planar while the undersurface of the sensor element 40 is slightly lower. The undersurfaces of plate 82 and shoe 59 contact and bear on the upper surface of material "M" substantially simultaneously, first at a level above the lower die plate and the rotor 94, and then move to bring the material down, essentially parallel to the matrix surface, to the plane of the upper edges of rotor 94 bounding its V-shaped notch. Note the complete balance and lack of contesting springs which might affect the balance of the material as it is moved. The anvil shoe and the stripper plate move down together and in process of reaching the level of the matrix surface of the plate 13 the toe of the shoe 59, comprised of its side surface 63, its radiused edge 62 and its undersurface adjacent the edge 62, which overlaps one projected edge of the side wall of the notch 96 of the rotor 94, moves against the material "M" to form and bend that portion of the material overlying the notch into the notch. In this process the portion of the material "M" involved forms about the toe of the shoe 59. This is the initial bending and forming function of the tool 10 as interrelated with its opposed forming die. The shoe would of course likewise function with any other forming die, in a suitable arrangement as prescribed by the shape thereof.

To this point there is still essentially complete balance of the material "M" in the bending and forming operation, avoiding any undue stress or distortion of the material in the process. Up to this time no cutting or punching tool has functioned.

Figure 13:
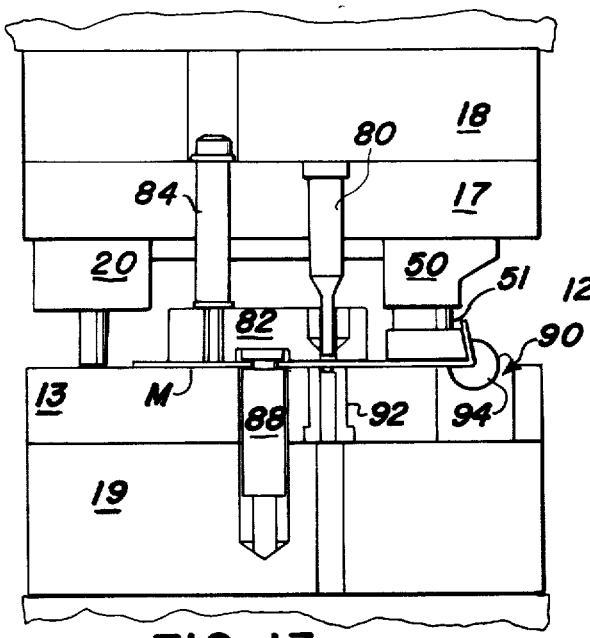
Figure 14:
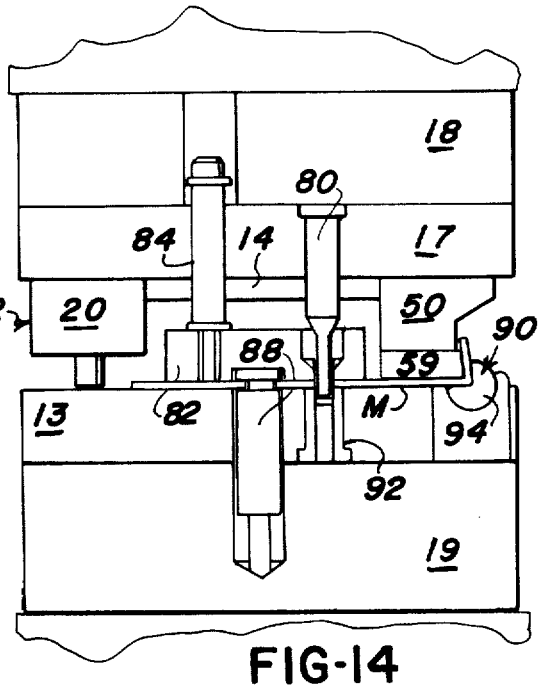

As seen in FIG. 13, as the upper half of the die system closes on the lower half and the initial bend and form operation is essentially complete, the downwardly projected end of sensor element 40 comes into contact with the die plate 13. As the closing of the die assembly continues, element 40 is forced upward of its housing, resulting, as is obvious and has been described, in an endwise movement of the bar 14. The bar 14 is cammed outwardly of the housing 20 by upward movement of sleeve 27, and the bar 14, in turn, cams the piston element 66 inwardly and downwardly of the cylinder 51, freeing the locking ball elements 74 in the anvil unit. This enables these ball elements, under the influence of the final closing force of the press and die assembly reactant on the shoe 59 and connected cylinder 51, to move inwardly of the reduced diameter section of the piston element 66 so the cylinder 51 and its contained components may be carried upwardly of and within the housing 50 to the extent of the axial length of the flat 53. Whereupon, and during the final movement of the upper half of the die in closing, not only do the cutting and punching tools function on the material but the cylinder 51 telescopes into the housing 50 and the upper edge of the shoe 59 seats against its bottom surface 58. This provides that the bent and formed portion of the material "M" is firmly and finally set in its required form by hard tooling.

In each stage of its operations the anvil unit provides hard rigid tooling. Air bending of the material is effected in one stage and a firm set of the bent and formed portion of the material is effected in the second stage of its operation.

The simple ball lock arrangements utilized provide positive control features. They enable solid extension of the anvil and have means associated therewith to insure quick positive release. There is no float of the invention apparatus which could cause malfunction or possible damage. Control of both stock or material worked and the bending and forming tool is simple and precise. The invention enables precision of control and accuracy in working.

Figure 15:
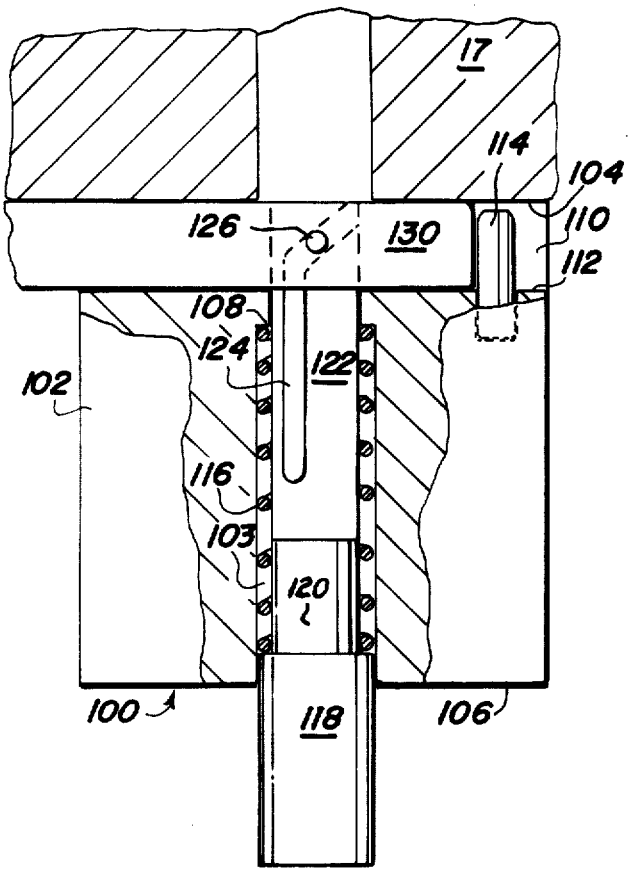
FIG. 15 is a generally schematic view of a second form of sensor part to replace that shown in FIGS. 3–5 and 10–14 wherein the device is partly broken away and sectioned.
Figure 16:
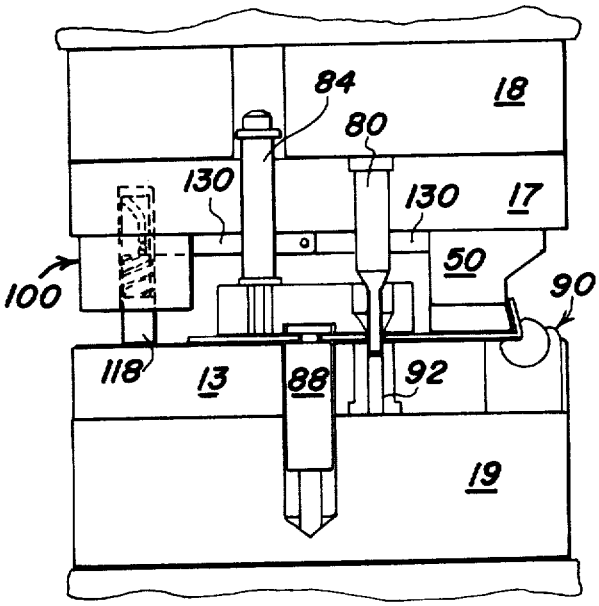
FIG. 16 is a view similar to FIG. 14 utilizing the sensor part viewed in the position shown in FIG. 15.

FIGS. 15 and 16 diagrammatically illustrate a further sensor unit of the invention which may be substituted for that just described in detail, and similarly function. The sensor unit 100 in this case is comprised of a rectangular block 102 having a central bore 103 opening at one end from its upper planar surface 104 and at its other end from its lower surface 106 which is parallel to the surface 104. The block 102 is suitably apertured to enable the application of screws by means of which it may be fixed to depend from the die plate 17 like the sensor part 12. The bore 103 is counterbored from its lower end, the major extent of its length, to produce in the wall thereof a shoulder 108 facing outwardly in the direction of the surface 106.

The upper surface 104 of the block 102 is intersected by a rectangular groove 110. The latter extends from side to side of the block to intersect about one-half the cross section of the bore 103. The innermost or base surface 112 of the groove 110 lies above and in spaced relation to the shoulder 108 and parallel to the surface 104. Fixed to project from and perpendicular to the surface 112, adjacent one end of the groove 110, is a pin 114 the axial extent of which lies within the limits of the groove.

A spring 116 seated at one end to the shoulder 108 within the bore 102 has its opposite end abutted to a shoulder formed on a cylindrical sensor element 118. The shoulder on the element 118 is created by a reduction in its diameter the length of its upper half 120 which is upwardly disposed in the bore 103. The upper approximately two-thirds of the half portion 120 is formed with a flat 122 the length thereof embodying therein a cam groove 124. The groove 124 extends from its innermost end first to one side of the axial center of the element 118 and parallel thereto to a point spaced from its outer upper end, from which point the groove is angled to open at one corner of the upper end of the flat which is at the opposite side of said axial center.

In application of the cylindrical sensor element 118 in the counterbore of bore 103, the spring 116 is placed under compression and the upper end of the flat 122 is projected from the surface 104 to enable a pin 126 fixed to project perpendicular to one side of a trigger bar element 130 to be entered in the angled upper end of groove 124. The bar element 130 is complementary in shape to the groove 110 and once the pin 126 is snapped into the upper end of the groove 124, the spring 116 is permitted to force the sensor 118 in and downwardly with respect to the block 100 to seat the bar element 130 in groove 110 with one end of the bar element 130 abutted to the pin and the other projected outwardly of the remote side of the block 100.

In use the bar element 130 is pinned to an axial extension thereof which extends to, relates to and operates an element 66 of the anvil part as does the end 71 of bar 14.

In closing of a die assembly wherein the sensor unit 12 is replaced by the sensor unit 100, the sensor cylinder 118 serves the same purpose as the element 40. As the element 118 is pressured inwardly of block 100 in closing of the die assembly, as described with reference to use of the element 40, it moves the upper flatted end portion thereof upwardly of the surface 104 to cam the projected end of bar 130 further outward relative to the block 100, thereby to cause its rigidly linked axial extension to depress element 66 of the related anvil part. There is an obvious resulting triggering of the unlocking of the element 51 from its fixed extended relation to its housing 50 as previously described. The only modification of the die assembly necessary to accommodate the upward projection of cylinder 118 is an aligned bore or recess which must be provided in the die plate or shoe from which the sensor unit 100 depends.

The sensor device of FIGS. 15 and 16 is simpler in make up than the device 12 and one benefit in its use is that the extension of bar 130 may be provided in different lengths to facilitate the best arrangement of the die system in which it is embodied.

The type of sensor or triggering arrangements here described have benefits of economy and simplicity of function. As can be seen, the invention contemplates various means and methods for triggering the reduction in length of the anvil unit, those of which illustrated have their merits making them options to suit the requirements of a particular application. While the sensor units are illustrated by way of example, the embodiments are not limited to those shown. One may, for example, if desired, integrate and mount the sensor element in connection with the anvil per se.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. Bending and forming apparatus comprising an anvil adapted for use in a press in conjunction with a die connected to an opposed portion of the press, to form and bend material interposed therebetween as the press closes during its cyclic operation, said anvil including a plurality of elements each of which is normally fixed to form an extension of another by embodied locking means, said anvil in its extended condition being a rigid unitized structure of substantially fixed length, said locking means being constructed and arranged to release to provide said elements as hard tooling of reduced length as bending and forming of the material worked thereby proceeds, to set the bent and formed configuration of the material worked and means for triggering said release of said locking means to provide for said reduction in length of said anvil, said triggering means including a cam device device which operates directly on a portion of said locking means.

2. Bending and forming apparatus comprising an anvil adapted for use in a press in conjunction with a die connected to an opposed portion of the press, to form and bend material interposed therebetween as the press closes during its cyclic operation, said anvil including a plurality of elements each of which is normally fixed to form an extension of another by embodied locking means, said anvil in its extended condition being a rigid unitized structure of substantially fixed length, said locking means being constructed and arranged to release to provide said elements as hard tooling of reduced length as bending and forming of the material worked thereby proceeds, to set the bent and formed configuration of the material worked and means for triggering said release of said locking means to provide for said reduction in length of said anvil, and said triggering means is an arm mounted in operative connection with and for movement relative to said anvil to operate at a predetermined point in the closing of the press in which the anvil is mounted.

3. Bending and forming apparatus comprising an anvil adapted for use in a press in conjunction with a die connected to an opposed portion of the press, to form and bend material interposed therebetween as the press closes during its cyclic operation, said anvil including a plurality of elements each of which is normally fixed to form an extension of another by locking means internally embodied therein, said anvil in its extended condition being a rigid unitized structure of substantially fixed length, said locking means being constructed and arranged to release to provide said elements as hard tooling of reduced length as bending and forming of the material worked thereby proceeds, to set the bent and formed configuration of the material worked and sensor means arranged to determine that point at which said locking means is released.

4. Bending and forming apparatus comprising an anvil adapted for use in a press in conjunction with a die connected to an opposed portion of the press, to form and bend material interposed therebetween as the press closes during its cyclic operation, said anvil including a plurality of elements each of which is normally fixed to form an extension of another by embodied locking means, said anvil in its extended condition being a rigid unitized structure of substantially fixed length, said locking means being constructed and arranged to release to provide said elements as hard tooling of reduced length as bending and forming of the material worked thereby proceeds, to set the bent and formed configuration of the material worked and sensor means arranged in relatively side by side relation with said anvil and operatively connected to said anvil by a trigger means through the medium of which to release said locking means.

5. Bending and forming apparatus comprising an anvil adapted for use in a press in conjunction with a die connected to an opposed portion of the press, to form and bend material interposed therebetween as the press closes during its cyclic operation, said anvil including a plurality of elements each of which is normally fixed to form an extension of another by embodied locking means, said anvil in its extended condition being a rigid unitized structure of substantially fixed length, said locking means being constructed and arranged to release to provide said elements as hard tooling of reduced length as bending and forming of the material worked thereby proceeds, to set the bent and formed configuration of the material worked, and said locking means being constructed and arranged to produce a friction lock between said elements to maintain said fixed length of said anvil.

6. Bending and forming apparatus comprising an anvil adapted for use in a press in conjunction with a die connected to an opposed portion of the press, to form and bend material interposed therebetween as the press closes during its cyclic operation, said anvil including a plurality of elements each of which is normally fixed to form an extension of another by embodied locking means, said anvil in its extended condition being a rigid unitized structure of substantially fixed length, said locking means being constructed and arranged to release to provide said elements as hard tooling of reduced length as bending and forming of the material worked thereby proceeds, to set the bent and formed configuration of the material worked, said elements comprising a pair thereof having a telescoped relation, the inner of said pair having a hollow, and control means housed in said inner of said pair and means included in bridging relation to said control means and the outer of said pair of elements to serve therewith as said locking means.

7. Apparatus as in claim 6 wherein said control means include a biased control element and opposed surface portions of said control element and the outer of said pair of elements have portions of their configuration complementary with that of said bridging means to produce a normally locked relation of said elements when the inner is positioned to form a predetermined extension of the outer to establish said fixed length of said anvil.

8. Apparatus as in claim 7 wherein said bridging means are ball-type elements contained for rotation in and to project from the inner of said telescoped elements.

9. Apparatus as in claim 8 wherein the projected extremity of said one of said elements outermost from the other mounts an anvil shoe which is peripherally extended and said shoe is arranged to bottom on the adjacent extremity of the outer of said elements on release of said locking means.

10. Bending and forming apparatus comprising an anvil adapted for use in a press in conjunction with a die connected to an opposed portion of the press, to form and bend material interposed therebetween as the press closes during its cyclic operation, said anvil including a plurality of elements each of which is normally fixed to form an extension of another by locking means internally embodied therein, said anvil in its extended condition being a rigid unitized structure of substantially fixed length, said locking means being constructed and arranged to release to provide said elements as hard tooling of reduced length as bending and forming of the material worked thereby proceeds, to set the bent and formed configuration of the material worked, and means for triggering the release of said locking means constructed and arranged to respond to a predetermined degree of closing of the press in which said anvil is mounted.

11. Bending and forming apparatus comprising an anvil adapted for use in a press in conjunction with a die connected to an opposed portion of the press, to form and bend material interposed therebetween as the press closes during its cyclic operation, said anvil including a plurality of elements each of which is normally fixed to form an extension of another by embodied locking means, said anvil in its extended condition being a rigid unitized structure of substantially fixed length, said locking means being constructed and arranged to release to provide said elements as hard tooling of reduced length as bending and forming of the material worked thereby proceeds, to set the bent and formed configuration of the material worked, and said apparatus being mounted to form part of a tool and die assembly in a press including an upper die plate and an opposite lower die plate mounting respectively to the upper and lower die shoes of the die assembly, at least one tool in connection with said upper die plate projecting therefrom and generally perpendicular thereto in the direction of a related die in connection with the lower die plate and a spring biased stripper plate mounted to be normally in advance of said tool having an aperture to pass said tool in the working thereof upon closing of the die assembly in said press, a forming die at least a portion of which is opposed to said anvil and said anvil having in operative association therewith a sensor device rendered operative during completion of the initial bend and form operation thereby to trigger the release of said locking means and provide for a predetermined reduction of said fixed length of said anvil in closing of said press and said die assembly.

12. Apparatus as in claim 11 wherein means are included for guiding the material to be worked in initially elevated relationship to the lower die plate and above the uppermost working surface portion of the forming die and said anvil is unopposed except for said forming die.

13. Apparatus as in claim 11 wherein said forming die is offset relative said anvil.

14. Apparatus as in claim 12 or claim 13 wherein said anvil is so mounted to said press to have the total bias thereon in use thereof applied through said press.

15. Apparatus as in claim 11 characterized in that said sensor device includes means arranged to engage said lower die plate in the press, in the process of which to be energized and to trigger said release of said locking means.

16. Apparatus as in claim 11 wherein said sensor device comprises a housing having a sensor element projected therefrom in the direction in which the die assembly closes, said housing mounts in spaced relation to said anvil and to be movable concurrently therewith, said sensor element being normally biased to project outwardly of said housing a predetermined degree and embodying cam means operable on a trigger means constructed and arranged to function in response to a predetermined pressuring of said sensor element inwardly of its housing to induce release of said locking means.

17. Apparatus as in claim 11 characterized in that said sensor device comprises a control element mounted for movement with and relative to said anvil constructed and arranged to respond to pressure applied thereto in closing of the die assembly to trigger a release of said locking means.

18. Bending and forming apparatus comprising a tool adapted for use in a press in conjunction with a die connected to an opposed portion of the press to form and bend material interposed therebetween as the press closes during its cyclic operation, said tool being adapted for connection to a base surface and including a plurality of coaxial telescopically related elements which are normally fixed to form an extension of one another by internally embodied locking means to normally provide them as a rigid unitized structure of substantially fixed length, said elements comprising a pair thereof, the inner of said pair having a hollow, control means being housed in said inner of said pair, means included in bridging relation to said control means and the outer of said pair of elements constructed and arranged to serve therewith as said locking means, said locking means being constructed and arranged to be released to free said normally fixed coaxially related elements from one another to permit movement of one thereof relative the other, subsequent to application of load thereon, to convert said tool to hard tooling of reduced length to set the bent and formed configuration of the material worked.

19. Apparatus as in claim 18 wherein said control means include a biased control element and surface portions of said control element and the outer of said pair of elements have portions of their configuration complementary with that of said bridging means to produce a normally locked relation of said pair of elements when the inner is positioned to form a predetermined extension of the outer thereof.

20. Apparatus as in claim 19 wherein said bridging means are ball-type elements contained for rotation in and to project from the inner of said telescoped elements.

21. Bending and forming apparatus comprising an anvil adapted for use in a press in conjunction with a die connected to an opposed portion of the press to form and bend material interposed therebetween as the press closes during its cyclic operation, said anvil being adapted for connection to a base surface and including a plurality of coaxially related elements which are normally fixed to form an extension of one another by locking means internally embodied therein to normally provide them as a rigid unitized structure of substantially fixed length, said coaxially related elements including an inner and an outer of said elements, said inner of said elements normally projecting outwardly from the outer thereof and mounting an anvil shoe which is peripherally extended, said locking means being constructed and arranged to be released to free said normally fixed coaxially related elements from one another to permit movement of one thereof relative the other, subsequent to application of load thereon, to convert said anvil to hard tooling of reduced length to set the bent and formed configuration of the material worked and said shoe being arranged to bottom on the adjacent extremity of the outer of said elements on release of said locking means.

22. Bending and forming apparatus comprising an anvil adapted for use in a press in conjunction with a die connected to an opposed portion of the press to form and bend material interposed therebetween as the press closes during its cyclic operation, said anvil being adapted for connection to a base surface and including a plurality of coaxially related elements which are normally fixed to form an extension of one another by locking means internally embodied therein to normally provide them as a rigid unitized structure of substantially fixed length, said locking means being constructed and arranged to be released to free said normally fixed coaxially related elements from one another to permit movement of one thereof relative the other, subsequent to application of load thereon, to convert said anvil to hard tooling of reduced length to set the bent and formed configuration of the material worked and means for triggering the release of said locking means constructed and arranged to respond to a predetermined degree of closing of the press in which said anvil is mounted.

23. Apparatus as in claim 22 mounted to form part of a tool and die assembly in a press including upper and lower die shoes, said anvil and at least one tool being in connection with said upper die shoe and projecting therefrom and generally perpendicular thereto in the direction of related dies in connection with the lower die shoe and a spring biased stripper plate mounted to be normally in advance of said tool having an aperture to pass said tool in the working thereof upon closing of the press, said related dies including a forming die at least a portion of which is opposed to said anvil and said anvil having in operative association therewith a sensor device rendered operative during completion of an initial bend and form operation to trigger the release of said locking means to provide for a predetermined reduction of said fixed length of said anvil in closing of said press.

24. Bending and forming apparatus comprising an anvil adapted for use in a press in conjunction with a die connected to an opposed portion of the press to form and bend material interposed therebetween as the press closes during its cyclic operation, said anvil being adapted for connection to a base surface and including a plurality of coaxially related elements which are normally fixed to form an extension of one another by internally embodied locking means to normally provide them as a rigid unitized structure of substantially fixed length, said locking means being constructed and arranged to be released to free said normally fixed coaxially related elements from one another to permit movement of one thereof relative the other, subsequent to application of load thereon, to convert said anvil to hard tooling of reduced length to set the bent and formed configuration of the material worked and said locking means being constructed and arranged to have a portion thereof frictionally fixed to one of said coaxially related elements which are in a normally fixed relation and in a supporting relation to the other thereof.

* * * * *